US008615827B2

(12) United States Patent
Newkirk et al.

(10) Patent No.: US 8,615,827 B2
(45) Date of Patent: Dec. 31, 2013

(54) PERSON-SUPPORT APPARATUS WITH MOVABLE PORTIONS

(75) Inventors: David C. Newkirk, Lawrenceburg, IN (US); Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 414 days.

(21) Appl. No.: 12/396,529

(22) Filed: Mar. 3, 2009

(65) Prior Publication Data

US 2010/0223727 A1 Sep. 9, 2010

(51) Int. Cl.
*A61G 7/015* (2006.01)

(52) U.S. Cl.
USPC ..... 5/602; 5/610; 5/611; 5/618; 5/619; 297/423.19

(58) Field of Classification Search
USPC ..... 5/602, 610, 611, 613, 618, 619, 624, 5/648, 942; 297/423.19, 423.22–423.24
See application file for complete search history.

(56) References Cited

U.S. PATENT DOCUMENTS

| | | | | |
|---|---|---|---|---|
| 1,160,451 | A | 11/1915 | Sanford | |
| 2,067,891 | A | 1/1937 | Comper | |
| 2,204,266 | A | 6/1940 | Wilcox | |
| 2,257,491 | A | 9/1941 | Armstrong | |
| 2,306,031 | A * | 12/1942 | Anderson et al. | 5/602 |
| 2,391,717 | A | 12/1945 | Lawrence | |
| 2,552,370 | A | 5/1951 | Curtis | |
| 3,817,512 | A | 6/1974 | Torrey | |
| 3,944,205 | A | 3/1976 | Mueller | |
| 4,243,263 | A * | 1/1981 | Thiboutot | 297/42 |
| 4,426,071 | A | 1/1984 | Klevstad | |
| 4,589,620 | A * | 5/1986 | Sakamoto | 248/550 |
| 5,214,812 | A | 6/1993 | Bartow et al. | |
| 5,369,827 | A | 12/1994 | Parke et al. | |
| 5,560,577 | A | 10/1996 | Keselman | |
| 5,720,471 | A * | 2/1998 | Constantinescu et al. | 267/81 |
| 5,926,878 | A | 7/1999 | Morton et al. | |
| 5,933,887 | A | 8/1999 | Strange et al. | |
| 5,941,175 | A * | 8/1999 | Bannister | 108/20 |
| 5,961,085 | A | 10/1999 | Navarro et al. | |

(Continued)

FOREIGN PATENT DOCUMENTS

| | | | |
|---|---|---|---|
| EP | 0642780 | A1 | 3/1995 |
| EP | 0580805 | B1 | 3/1999 |

(Continued)

*Primary Examiner* — Peter M Cuomo
*Assistant Examiner* — Brittany Wilson
(74) *Attorney, Agent, or Firm* — Barnes & Thornburg LLP

(57) ABSTRACT

A person-support apparatus comprises a lower frame, a support, and an upper frame. The support is coupled to the lower frame. The upper frame is supported on the support above the lower frame. The upper frame includes a head support section and a foot support section including a first portion and a second portion. The first portion and the second portion are configured to support at least a portion of the lower extremities of a person supported on the person-support apparatus. No components of the first portion and the second portion are removed from the first portion and the second portion when the first portion and the second portion are moved from a first position to a second position. The person-support apparatus can be configured to support any one of the posterior pelvic region and the feet, calf region, upper torso, or feet of a person on the foot section.

23 Claims, 8 Drawing Sheets

(56) References Cited

U.S. PATENT DOCUMENTS

| | | | | |
|---|---|---|---|---|
| 6,202,230 | B1 * | 3/2001 | Borders | 5/618 |
| 6,234,173 | B1 | 5/2001 | Hajianpour | |
| 6,263,527 | B1 * | 7/2001 | Ross et al. | 5/118 |
| 6,289,537 | B1 | 9/2001 | Hopper et al. | |
| 6,315,319 | B1 * | 11/2001 | Hanson et al. | 280/650 |
| 6,446,282 | B1 * | 9/2002 | Wu | 5/115 |
| 6,446,287 | B2 * | 9/2002 | Borders | 5/618 |
| 6,654,974 | B2 * | 12/2003 | Ruehl et al. | 5/621 |
| 6,948,202 | B2 | 9/2005 | Weismiller | |
| 7,165,277 | B2 * | 1/2007 | Taguchi et al. | 5/618 |
| 7,234,180 | B2 * | 6/2007 | Horton et al. | 5/613 |
| 7,448,100 | B1 * | 11/2008 | Shih | 5/600 |
| 7,454,806 | B2 * | 11/2008 | Koch et al. | 5/624 |
| 7,464,421 | B2 | 12/2008 | Goodwin et al. | |
| 7,469,433 | B2 | 12/2008 | Ruehl et al. | |
| 7,698,756 | B1 * | 4/2010 | Chen | 5/113 |
| 7,886,379 | B2 * | 2/2011 | Benzo et al. | 5/612 |
| 7,900,302 | B2 * | 3/2011 | Long | 5/618 |
| 2002/0083527 | A1 | 7/2002 | Ruehl et al. | |
| 2002/0095728 | A1 | 7/2002 | Weismiller | |
| 2004/0068797 | A1 * | 4/2004 | Smith et al. | 5/617 |
| 2006/0117485 | A1 | 6/2006 | Brophy et al. | |
| 2006/0168727 | A1 | 8/2006 | Heimbrock | |
| 2007/0000057 | A1 * | 1/2007 | Ward | 5/611 |
| 2008/0235875 | A1 | 10/2008 | Wells | |
| 2009/0038073 | A1 * | 2/2009 | Dippl et al. | 5/611 |
| 2009/0300844 | A1 * | 12/2009 | Taylor | 5/607 |
| 2010/0275376 | A1 * | 11/2010 | Benzo et al. | 5/618 |
| 2010/0287699 | A1 * | 11/2010 | Brune | 5/111 |
| 2011/0191959 | A1 * | 8/2011 | Hornbach et al. | 5/611 |
| 2011/0219545 | A1 * | 9/2011 | Dorenbeck et al. | 5/611 |

FOREIGN PATENT DOCUMENTS

| | | | |
|---|---|---|---|
| EP | 0803239 | B1 | 11/2001 |
| EP | 1565143 | B1 | 4/2006 |
| EP | 1707173 | A1 | 10/2006 |
| EP | 1787618 | A2 | 5/2007 |
| EP | 1787619 | A2 | 5/2007 |
| EP | 1639980 | B1 | 1/2008 |
| EP | 1917950 | A2 | 5/2008 |
| WO | 9734520 | A2 | 9/1997 |
| WO | 0193796 | A2 | 12/2001 |

* cited by examiner

PERSON-SUPPORT APPARATUS WITH MOVABLE PORTIONS

BACKGROUND OF THE DISCLOSURE

This disclosure relates generally to person-support apparatuses. More particularly, but not exclusively, this disclosure relates to person-support apparatuses with movable portions.

Person-support apparatuses such as birthing beds provide support for patients during medical procedures. In the case of birthing beds, the person-support apparatus supports the mother throughout the labor and delivery of a baby. During the medical procedures or birthing process, the person-support apparatus may need to be configured to provide improved access to a portion of the patient's body to a caregiver while maintaining the patient in a comfortable position. While various person-support apparatuses have been developed, there is still room for improvement. Thus, a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the current disclosure can include a person-support apparatus with a foot section having a first portion and a second portion movable with three degrees of freedom from a first position to a second position. Another illustrative embodiment can include a person-support apparatus with a foot section having a first portion configured to support the feet of a person and a second portion configured to support the posterior pelvic region of the person above the first portion. Yet another illustrative embodiment can include a person-support apparatus with a foot section with a first portion and a second portion that can be reshaped to the contour of at least a portion of the lower extremities of a person.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
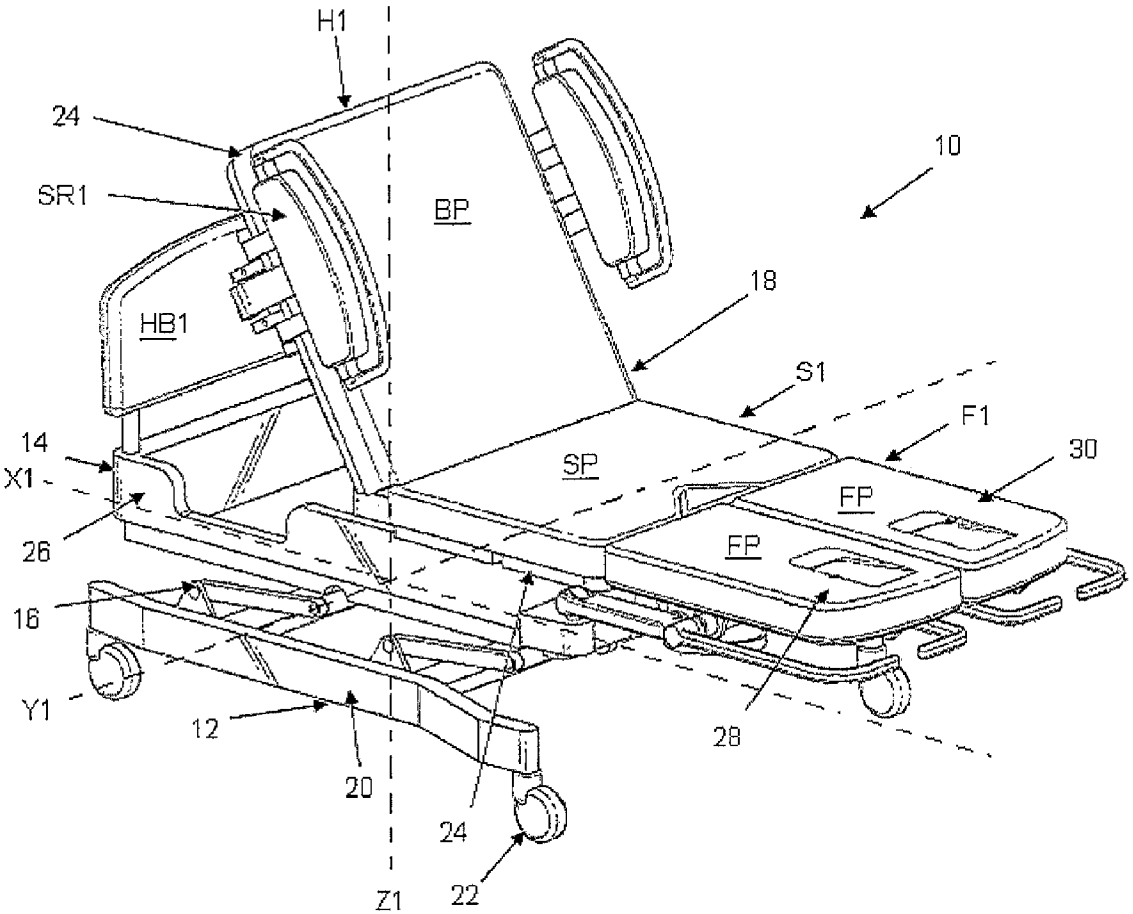
FIG. 1 is a perspective view of a person-support apparatus according to one illustrative embodiment of the disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the current disclosure can include a person-support apparatus with a foot section having a first portion and a second portion movable with three degrees of freedom from a first position to a second position. Another illustrative embodiment can include a person-support apparatus with a foot section having a first portion configured to support the feet of a person and a second portion configured to support the posterior pelvic region of the person above the first portion. Yet another illustrative embodiment can include a person-support apparatus with a foot section with a first portion and a second portion that can be reshaped to the contour of at least a portion of the lower extremities of a person.

A person-support apparatus 10 according to one illustrative embodiment of the current disclosure is shown in FIG. 1. The person-support apparatus 10 can be a hospital bed and can include a lower frame 12 or base 12, an upper frame 14, and a plurality of supports 16 coupled with the upper frame 14 and the lower frame 12. It should be appreciated that the person-support apparatus 10 can also be a hospital stretcher or an operating table. It should also be appreciated that the person-support apparatus 10 can include only one support 16. The person-support apparatus 10 can include a head support section H1 or torso support section H1, where the head of a person (not shown) is positioned, a foot section F1, where the feet of a person (not shown) are positioned, and a seat section S1 positioned between the head section H1 and the foot section F1. It should be appreciated that the head section H1 and the seat section S1 can be portions of the same section. The head section H1 can be pivoted relative the foot section F1 and the seat section S1 so that the person-support apparatus 10 can be articulated between a generally horizontal lying-down position, a reclined position, a sitting position, and an infinite number of intermediate positions therebetween. The foot section F1 can be moved and/or pivoted relative to the head section H1 and the seat section S1 so that the person-support apparatus 10 can be articulated between a generally horizontal lying-down position, a generally horizontal lithotomy position with the person's lower extremities are supported above the person's pelvic region position, a generally reclining sitting-up position, and an infinite number of intermediate positions therebetween. It should be appreciated that the head section H1 and the foot section F1 can be moved/pivoted simultaneously and/or independently of one another.

The person-support apparatus 10 can support a person-support surface 18 on the upper frame 14 as shown in FIG. 1. The person-support surface 18 can be configured to support a person (not shown) in multiple articulated positions. The person-support surface 18 can be formed of multiple sections that can include a back portion BP, a foot portion FP, and a seat portion SP between the back portion BP and the foot portion FP. The back portion BP and the seat portion SP can be connected together, and the seat portion SP and the foot portion FP can be separate. It should be appreciated that the back portion BP and the seat portion SP can be separate. It should also be appreciated that the foot portion FP can include separate sides. It should further be appreciated that a portion of the seat portion SP can be removed, and that none of the components of the foot portion FP are removable. The person-support surface 18 can include one or more support sections having foam and/or air bladders that deliver therapy to the person through expansion/contraction, changes in pressure, and/or blowing air. For example, one or more sections of surface 18 can provide alternating pressure therapy, continuous lateral rotation therapy, low air loss therapy, boost assistance, percussion/vibration therapy, and/or turn assistance.

The lower frame 12 can couple with the supports 16 to support the supports 16 and the upper frame 14. The lower frame 12 can include a single lower frame section 20 supported by casters 22 as shown in FIG. 1. It should be appreciated that the lower frame 12 can include multiple lower frame sections 20. It should also be appreciated that the lower frame 12 can not be supported by casters 22 and instead can be supported by posts (not shown).

The supports 16 can be a parallelogram linkage 16 that can be coupled between the lower frame 12 and the upper frame 14 as shown in FIG. 1. The supports 16 can define a vertical axis Z1 that extends through the lower frame 12 and the upper frame 14 and can be substantially perpendicular the lower frame 12 and the upper frame 14 when the lower frame 12 is parallel the upper frame 14. The supports 16 can be a parallelogram linkage. It should be appreciated that the supports 16 can be other lift mechanisms 16 with a lift driver (not shown) that can cause the lift mechanisms 16 to expand and/or contract to raise and/or lower the upper frame 14 with respect to the lower frame 12. It should also be appreciated that the supports 16 can be or can include at least one of telescoping towers, scissor lifts, rotational lifts, hydraulic lifts or actuators, pneumatic lifts or actuators, linear actuators, electronic actuators, chain lifts, or other lift mechanisms. It should further be appreciated that the supports 16 can instead be at least one fixed column (not shown).

The upper frame 14 can define a longitudinal axis X1 and a lateral axis Y1 as shown in FIG. 1. The longitudinal axis X1 can extend at least the length of the person-support apparatus 10 through the head end H1 and the foot end F1 along the lateral center of the upper frame 14. The lateral axis Y1 can be perpendicular the longitudinal axis X1 and extend at least the width of the person-support apparatus 10 through the longitudinal center of the upper frame 14. The upper frame 14 can include a deck 24 that can be supported by an intermediate frame 26. It should be appreciated that the upper frame 14 can also include a head board HB1 and/or side rails SR1 that can be supported by the intermediate frame 26 or deck 24. It should also be appreciated that the upper frame 14 can be a deck 24. The deck 24 can be comprised of multiple sections that can articulate about the lateral axis Y1. It should be appreciated that one or more of the deck 24 and the intermediate frame 26 can articulate about the lateral axis Y1 or an axis parallel thereto. It should also be appreciated that the deck 24 can not articulate.

Figure 2:
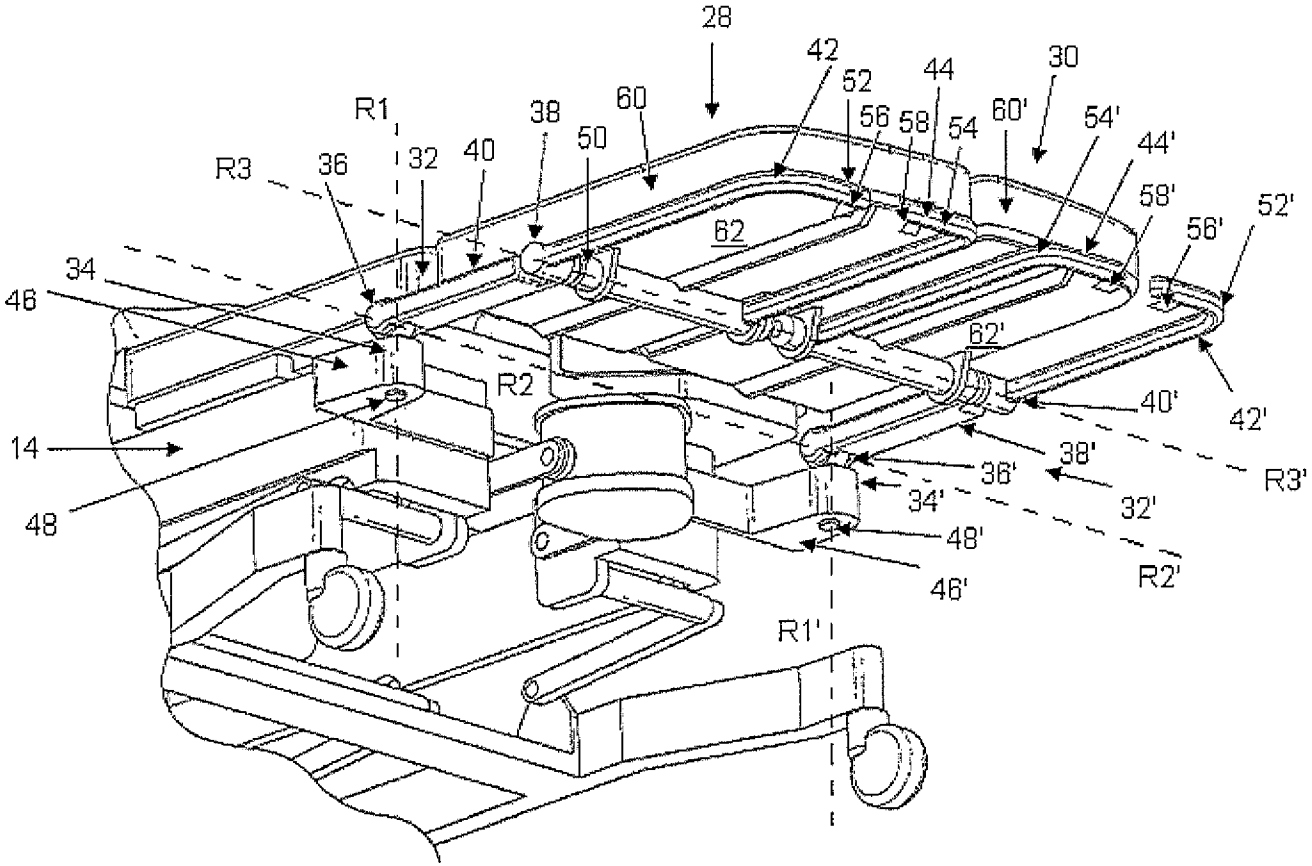
FIG. 2 is a perspective view of a foot section of the person-support apparatus of FIG. 1 including a first portion and a second portion utilizing a set of three movable joints.

The foot section F1 can include a first foot portion 28, a second foot portion 30, and a movement assembly 32 that can movably couple the first foot portion 28 and the second foot portion 30 to the upper frame 14 as shown in FIG. 2. For the sake of brevity, elements of the first foot portion 28 that appear to be mirror images of elements of the second foot portion 30 can be constructed and operated similarly and are designated by the same reference numerals suffixed by an apostrophe sign. The movement assembly 32 allows for movement of the first foot portion 28 and the second foot portion 30 with respect to one another and the upper frame 14. The movement assembly 32 can include a first joint 34, a second joint 36, a third joint 38, a movement member 40 extending between the second joint 36 and the third joint 38, an outer handle 42, and an inner handle 44.

The first joint 34 can include a first joint receptacle 46 coupled with the upper frame 14 that can be configured to receive a first end of a first joint post 48 as shown in FIG. 2. It should be appreciated that the first joint receptacle 46 can be rotatably coupled to the upper frame 14. It should also be appreciated that the first joint receptacle 46 can be coupled to a height adjustment mechanism 134 shown and described below in connection with FIG. 8. The first joint post 48 can rotate with respect to the first joint receptacle 46 and can define a first rotational axis R1 that can be substantially parallel the vertical axis Z1.

The second joint 36 can include a second end of the first joint post 48 rotatably coupled with a first end of the movement member 40 as shown in FIG. 2. The second joint 36 can define a second rotational axis R2 that can be substantially horizontal. It should be appreciated that the second joint 36 could be a ball-in-socket arrangement that couples to the first joint receptacle 46, negating the need for the first joint post 48.

The third joint 38 can include a second end of the movement member 40 and a first end of a foot portion joint 50 as shown in FIG. 2. The foot portion joint 50 can be coupled to the first foot portion 28. It should be appreciated that the foot portion joint 50 can be integrated into the first foot portion 28. It should also be appreciated that the foot portion joint 50 can extend transversely along the underside of the first foot portion 28. The third joint 38 can define a third rotational axis R3 that can be substantially parallel to the second rotational axis R2.

The first joint, the second joint, and the third joint can be locked to prevent pivoting and unlocked to allow pivoting by utilizing remotely activated locking and pivoting joints. In one illustrative embodiment, the movable joints can be remotely actuated by a transmission device, such as a cable or pneumatically to allow selective unlocking, in order to allow pivoting, and fixing, or locking of the movable joints to prevent pivoting. Such joints are available commercially from manufacturers, such as, Adjustable Locking Technologies, LLC under the trademark INFILOC and VARILOC. Other selectively lockable and pivotable joints are within the scope of this invention. One example can be a spline-type movable joint (not shown) in which the spline is meshed or engaged to lock the movable joint to prevent pivotal movement of the movable joint or not meshed, disengaged to allow pivotal movement of the movable joint. Another example can be a clutch-type movable joint (not shown) in which clutch friction pads are engaged to lock the movable joint to prevent movement of the movable joint or disengaged to allow pivotal movement of the movable joint.

The outer handle 42 and the inner handle 44 can facilitate positioning of the first foot portion 28 and the second foot portion 30 in a plurality of positions as shown in FIG. 2. The outer handle 42 can be coupled to the third joint 38 and can be L-shaped, extending along a portion of the perimeter of the first foot portion 28. It should be appreciated that the outer handle 42 can be integrally formed with and extend from the second end of the movement member 40. It should also be appreciated that the outer handle 42 can be coupled to or integrally formed with the first foot portion 28. It should further be appreciated that the outer handle 42 can be other shapes. The outer handle 42 can rotate with the first foot portion 28 about the first rotational axis R1, the second rotational axis R2, and the third rotational axis R3. It should be appreciated that the outer handle 42 can rotate only about the first rotational axis R1 and the second rotational axis R2. The outer handle 42 can include an outer handle grip 52 that can be gripped by an operator and used to move the first foot portion 28 with respect to the second foot portion 30 and the seat section S1 about the first rotational axis R1, the second rotational axis R2, and/or the third rotational axis R3.

The inner handle 44 can be coupled to a second end of the foot portion joint 50 and can be L-shaped, extending along a portion of the perimeter of the first foot portion 28 as shown in FIG. 2. It should be appreciated that the inner handle 44 can be coupled to or integrally formed with the first foot portion 28. It should also be appreciated that the inner handle 44 can also be in other shapes. The inner handle 44 can rotate with the first foot portion 28 about the first rotational axis R1 and the third rotational axis R3. It should be appreciated that the inner handle 44 can rotate with the first portion about one or more of the first rotational axis R1, the second rotational axis R2 and the third rotational axis R3. The inner handle 44 can include an inner handle grip 54 that can be gripped by an operator and used to move the first foot portion 28 with respect to the second foot portion 30 and the seat section S1 about the first rotational axis R1, the second rotational axis R2, and/or the third rotational axis R3.

The outer handle 42 and the inner handle 44 can include actuators 56, 58 positioned proximate the outer handle grip 52 and the inner handle grip 54, respectively, as shown in FIG. 2. It should be appreciated that the actuators 56, 58 may only be on one of the outer handle 42 and the inner handle 44. The actuators 56, 58 can cause at least one of the first joint 34, the second joint 36, and the third joint 38 to lock/unlock thereby allowing/preventing movement of the first foot portion 28 with respect to the second foot portion 30 and the seat section S1. It should also be appreciated that the actuators 56, 58 can selectively or simultaneously lock/unlock the first joint 34, the second joint 36, and the third joint 38. It should also be appreciated that the outer handle 42 and the inner handle 44 can include separate actuators 56, 58 for each of the first joint 34, the second joint 36, and the third joint 38. It should further be appreciated that only one actuator 56, 58 can be included on one of the outer handle 42 and the inner handle 44 to lock/unlock all of the first joint 34, the second joint 36, and the third joint 38. The actuators 56, 58 can be levers 56, 58 coupled within the outer handle 42 and the inner handle 44 and protrude therefrom. It should be appreciated that the actuators 56, 58 can be positioned on the outer surface of the outer handle 42 and the inner handle 44 and can be push button actuators 56, 58 or electronic actuators 56, 58 or other similar actuators. The actuators 56, 58 can be compressed to actuate the actuators 56, 58. It should be appreciated that the actuators 56, 58 can be slid, rotated, pulled, or the like to lock/unlock the joints. The actuators 56, 58 can be connected to the first joint 34, the second joint 36, and the third joint 38 via cables (not shown). It should be appreciated that the actuators 56, 58 can be connected to the first joint 34, the second joint 36, and the third joint 38 via other linkages or mechanical, electrical, hydraulic, or pneumatic arrangements.

The first foot portion 28 and second foot portion 30 can be adapted to support at least a portion of the lower extremities of a person supported on the person-support apparatus 10 as shown in FIG. 2. It should be appreciated that the lower extremities of the person can include posterior pelvic region, feet, calf region, and thigh regions of the person. The first foot portion 28 and the second foot portion 30 can be selectively movable and can move with at least three degrees of freedom from a first position to a second position. The movements of the first foot portion 28 and second foot portion 30 allow the person-support apparatus 10 to be maneuvered to different positions in which the portion of the lower extremities of the person can be supported during treatment as shown in FIGS. 3-7 and described below.

The first foot portion 28 can be rotatably coupled with the foot portion joint 50 and can include a pad 60 supported on a pad support 62 as shown in FIGS. 1 & 2. The pad 60 can be part of the foot portion FP previously described above and can be composed of the same materials as the person support surface 18 and can include a shapeable member (not shown) proximate the pad support 62 that can be shaped into one or more shapes to partially contour the area of the lower extremity of the person to help retain the lower extremities of the person. It should be appreciated that the pad 60 can be shaped manually (by hand) or automatically with an actuator. It should also be appreciated that the pad 60 can be pre-shaped to partially contour the area of the lower extremity of the person. It should further be appreciated that the pad support 62 can be the resilient, bendable member and can be constructed of a bendable metal plate 62 or other material that can be shaped into one or more shapes to partially contour the area of the lower extremity of the person to help retain the lower extremities of the person. The pad 60 can include a foot recess 62 configured to receive the foot of a person as shown in FIG. 1.

In operation the first foot portion 28 and the second foot portion 30 are positioned in a first position adjacent one another in substantially the same horizontal plane as the seat section S1. To move the first foot portion 28 and the second foot portion 30 to a second position, i.e., a foot support position, an upper body support, a lithotomy position, a feet and lower pelvic support (an epidural) position, or a calf support position as described below, the actuators 56, 58 on one of the outer handle 42 and/or the inner handle 44 are compressed and actuated to unlock the first joint 34, the second joint 36, and the third joint 38. Once the joints are unlocked and while the actuators are still compressed, one of the outer handle 42 and/or the inner handle 44 is moved horizontally, vertically, or a combination of horizontally and vertically to a desired second position. Upon reaching the desired second position, the actuators 56, 58 are released to lock the first joint 34, the second joint 36, and the third joint 38 in position.

Figure 3:
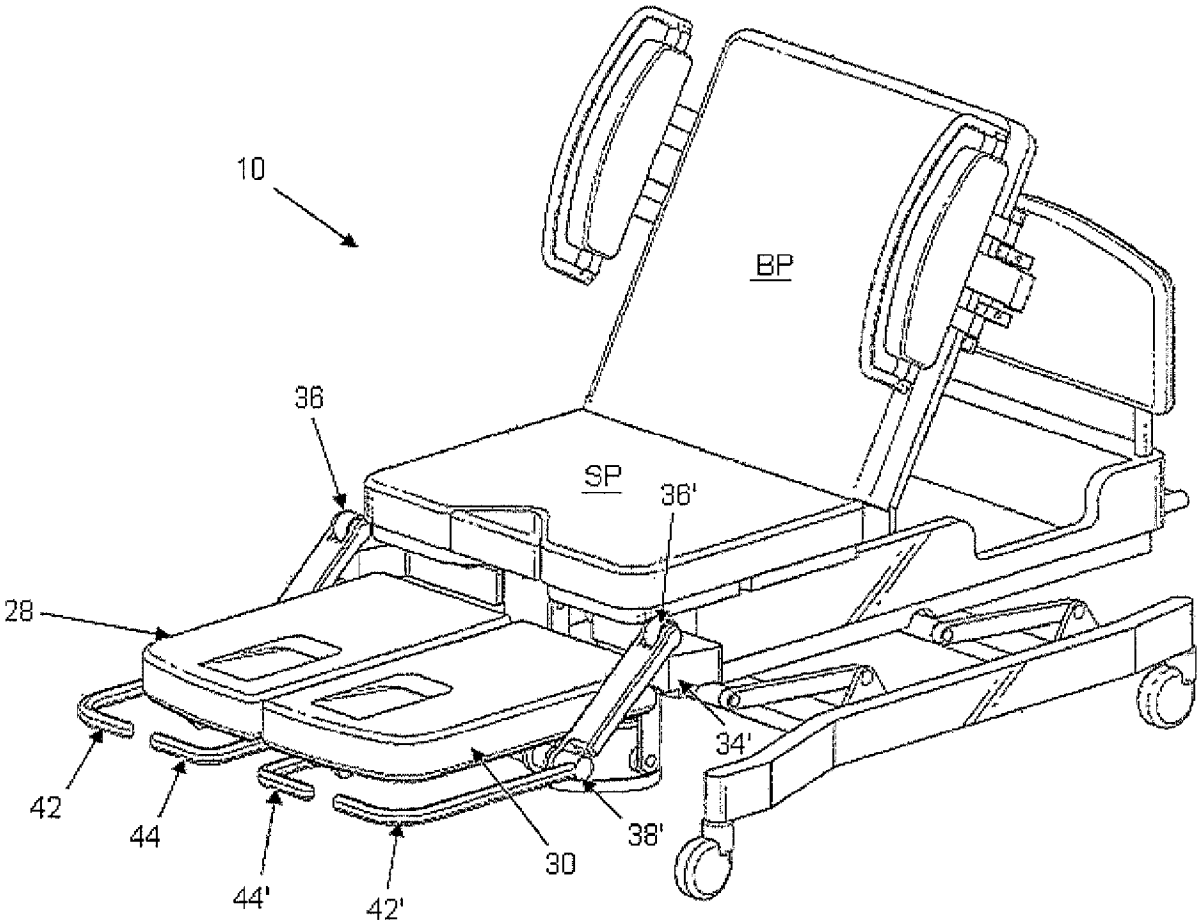
FIG. 3 is a perspective view of the person-support apparatus of FIG. 1 having the first and the second portions arranged in a foot support position.

In one illustrative embodiment, the person-support apparatus 10 can be configured into a foot support position as shown in FIG. 3. In this position, support can be provided to the feet of a person seated on the person-support apparatus 10. To achieve this configuration, the first foot portion 28 and second foot portion 30 are moved downward upon actuating the actuator 56, 58 to unlock the joints 34, 36, 38 by utilizing the outer handle 42 and/or the inner handle 44 to rotate the second joint 36 and the third joint 38. It should be appreciated that the head section H1 does not need to be articulated.

Figure 4:
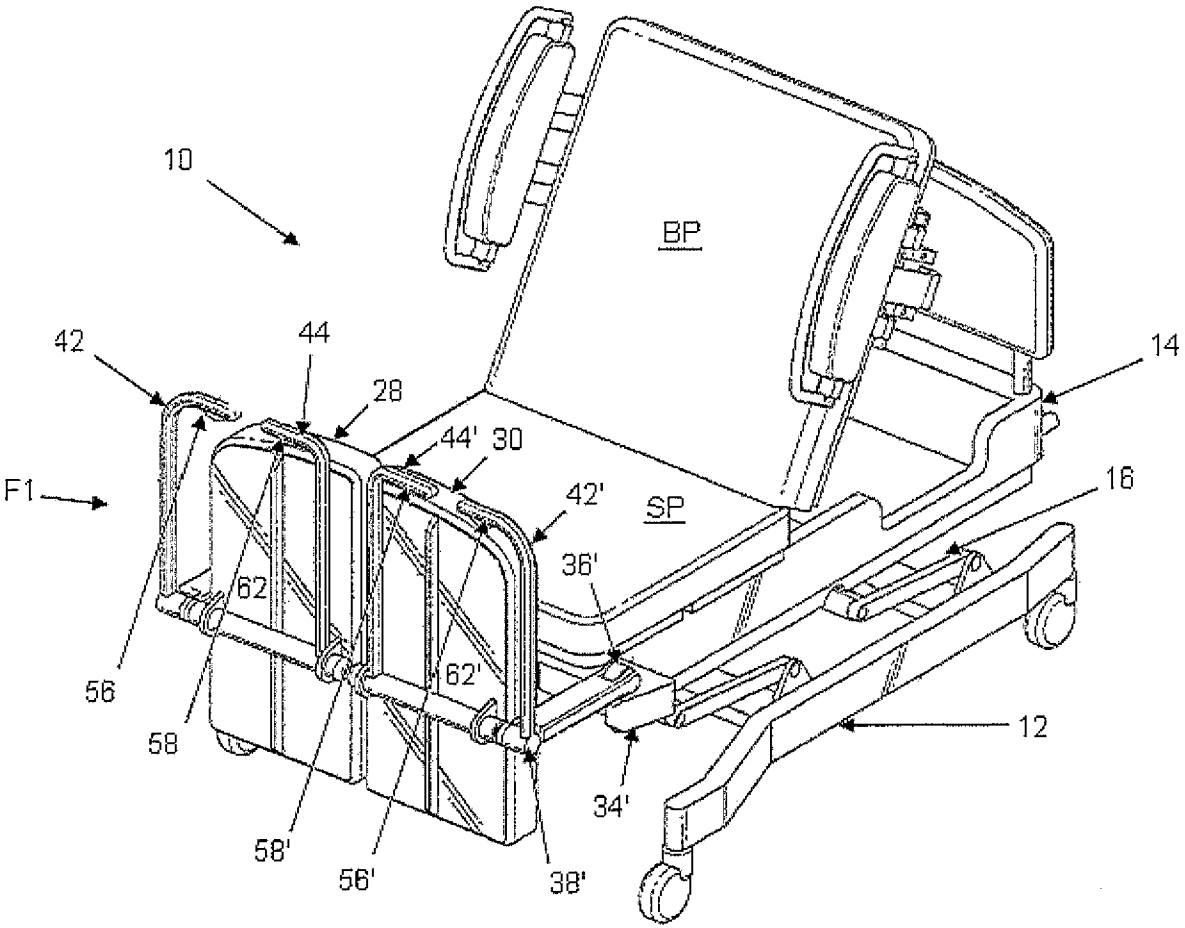
FIG. 4 is a perspective view of a person-support apparatus of FIG. 1 with the first and the second portions arranged in an upper body support position.

In another illustrative embodiment, the person-support apparatus 10 can be configured into an upper-body or laborbar support position as shown in FIG. 4. In the upper-body support position, the first foot portion 28 and the second foot portion 30 can be rotated about the third rotational axis R3 utilizing the outer handle 42 and/or the inner handle 44 to support the upper torso of a person on the person-support apparatus 10. To achieve this configuration, the first foot portion 28 and the second foot portion 30 can be rotated about the third rotational axis R3 upon actuating the actuator 56, 58 to unlock the joints 34, 36, 38 by utilizing the inner handle 44 such that the first foot portion 28 and the second foot portion 30 are substantially parallel the vertical axis Z1. It should be appreciated that in other embodiments the outer handle 42 can be utilized to rotate the first foot portion 28 and the second foot portion 30 about the third rotational axis R3. A person supported on the person-support apparatus can lean on the first foot portion 28 and the second foot portion 30 and/or on at least one of the outer handle 42 and the inner handle 44 to support themselves. It should be appreciated that the first foot portion 28 and the second foot portion 30 can be substantially perpendicular to or at an angle with respect to the head support section H1. It should also be appreciated that there may be a gap between the head support section H1 and the first foot portion 28 and the second foot portion 30 when the first foot portion 28 and the second foot portion 30 are substantially perpendicular to the head support section H1 so that the person can position their legs between the head support section H1, first foot portion 28 and the second foot portion 30. It should further be appreciated that there may be a foot support (not shown) positioned within the gap between the head support section H1, first foot portion 28 and the second foot portion 30.

Figure 5:
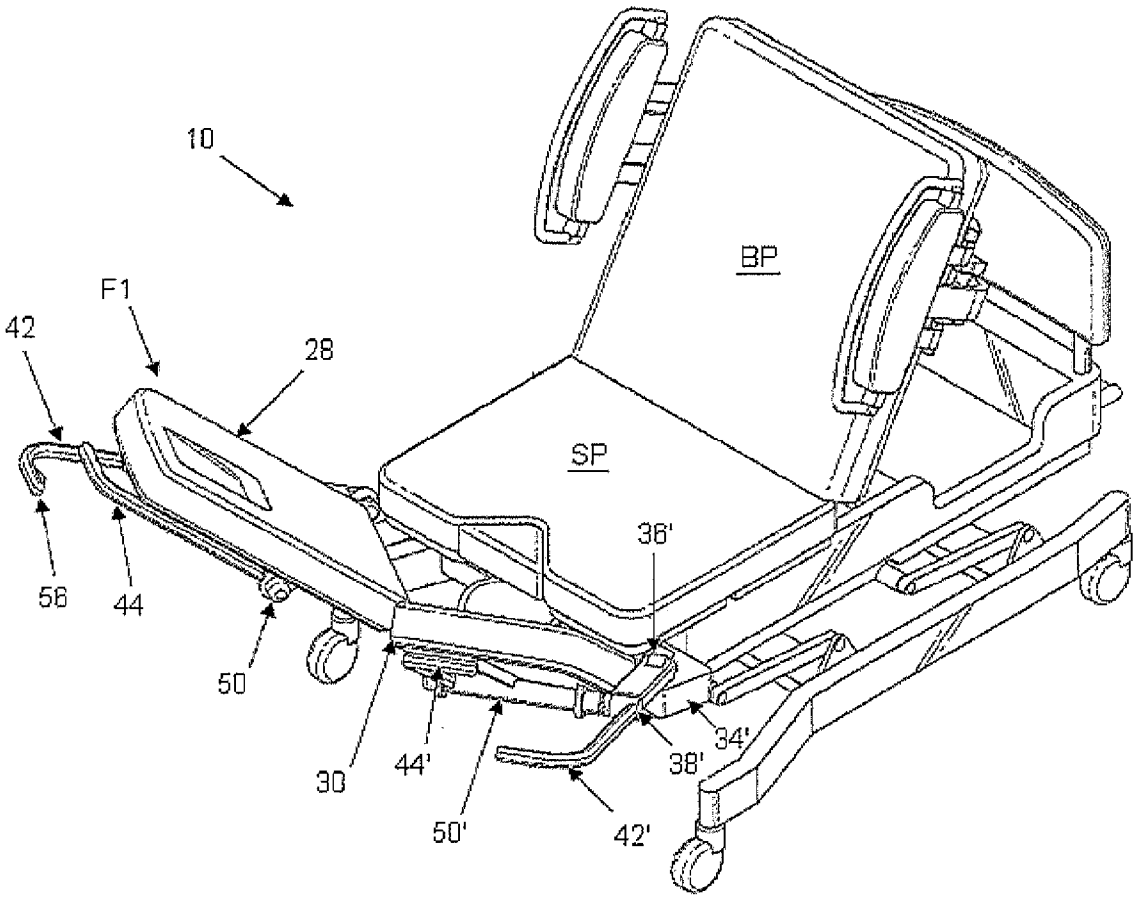
FIG. 5 is a perspective view of a person-support apparatus of FIG. 1 with the first and the second portions arranged in the lithotomy position.

In yet another illustrative embodiment, the person-support apparatus 10 can be configured into a lithotomy or raised position as shown in FIG. 5. In the lithotomy position, the first foot portion 28 and the second foot portion 30 support the feet of a person positioned on the person-support apparatus 10 such that their feet are supported a distance apart from each other above the lower pelvic region of the person. To achieve this configuration, the portions 28, 30 can be rotated about the rotational axes R1, R2, and R3 by actuating the actuators 56, 58 to unlock the joints 34, 36, 38, and using the handles 42, 44 to move the portions 28, 30 substantially off the lateral center of the person-support apparatus 10 and above the pelvic region of the person, and orient the portions such that they are perpendicular with respect to the seat section S1. It should be appreciated that the first foot portion 28 and the second foot portion 30 can remain parallel to the upper frame 14 when positioned above the pelvic region of the person supported on the person-support apparatus 10. It should also be appreciated that the first foot portion 28 and the second foot portion 30 can remain level with the seat section S1 when they are rotated such that they are substantially off the lateral center of the person-support apparatus 10. It should further be appreciated that the first foot portion 28 and the second foot portion 30 can be rotated about the third rotational axis R3 utilizing the outer handle 42 and/or the inner handle 44 to orient the first foot portion 28 and the second foot portion 30 such that they are at an angle with respect to the person-support apparatus 10.

Figure 6:
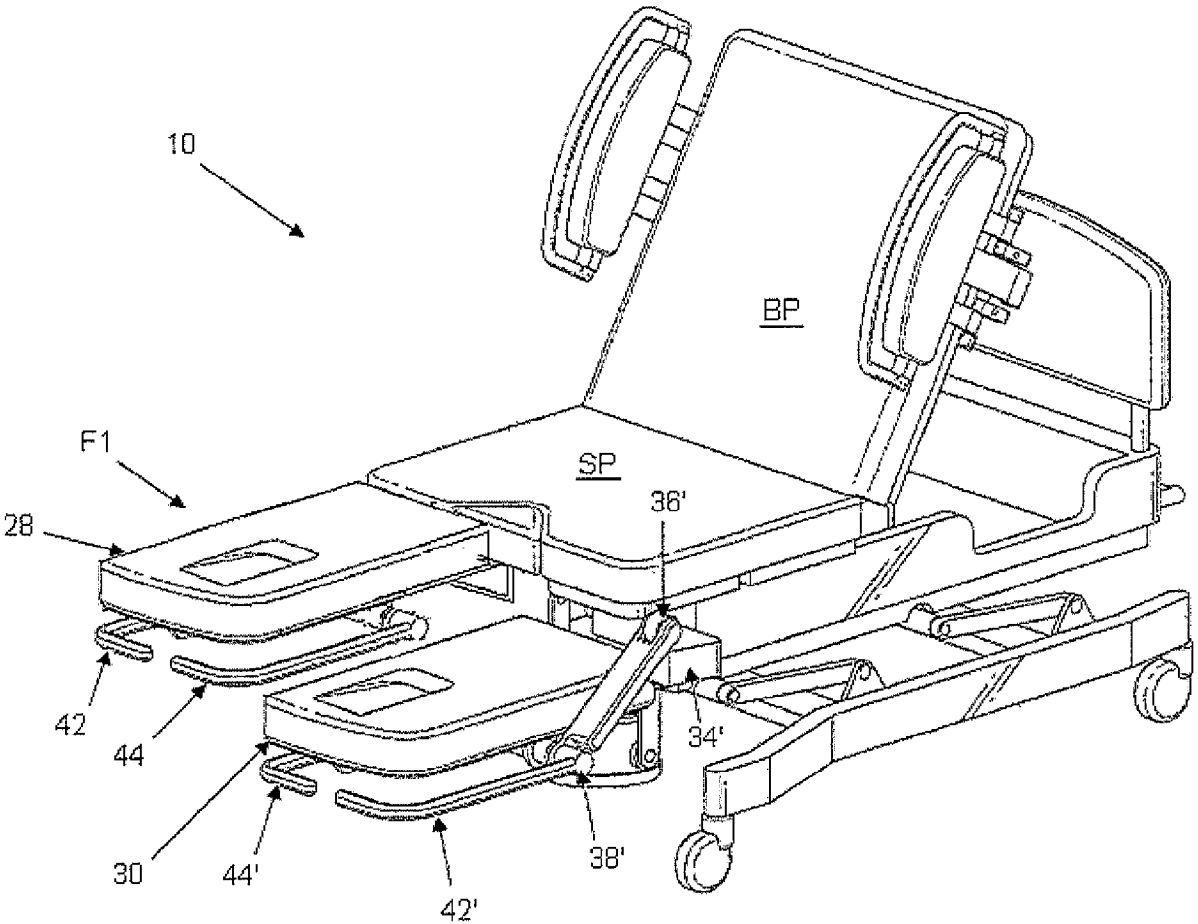
FIG. 6 is a perspective view of a person-support apparatus of FIG. 1 with the first and the second portions arranged in a feet and lower pelvic region support position.

In still another illustrative embodiment, the person-support apparatus 10 can be configured into an epidural position as shown in FIG. 6. In this position, support can be provided to the feet of a person seated on the foot section F1. This position may be utilized when administering epidural anesthesia. It should be appreciated that one of the first foot support 28 and the second foot support 30 can provide support to at least one of a person's feet and the other of the first foot support 28 and the second foot support 30 can provide support to the lower pelvic region of the person. To achieve this configuration, one of the first foot portion 28 and second foot portion 30 can be moved downward upon actuating the actuator 56, 58 to unlock the joints 34, 36, 38 by utilizing the outer handle 42 and/or the inner handle 44, while the other of the first foot portion 28 and second foot portion 30 remains in substantially the same horizontal plane as the seat section S1. It should be appreciated that the other of the first foot portion 28 and second foot portion 30 can be raised or lowered so that it is not in the same horizontal plane as the seat section S1 as long as the second of the first foot portion 28 and second foot portion 30 remains above the other of the first foot portion 28 and second foot portion 30 supporting the feet of the person.

Figure 7:
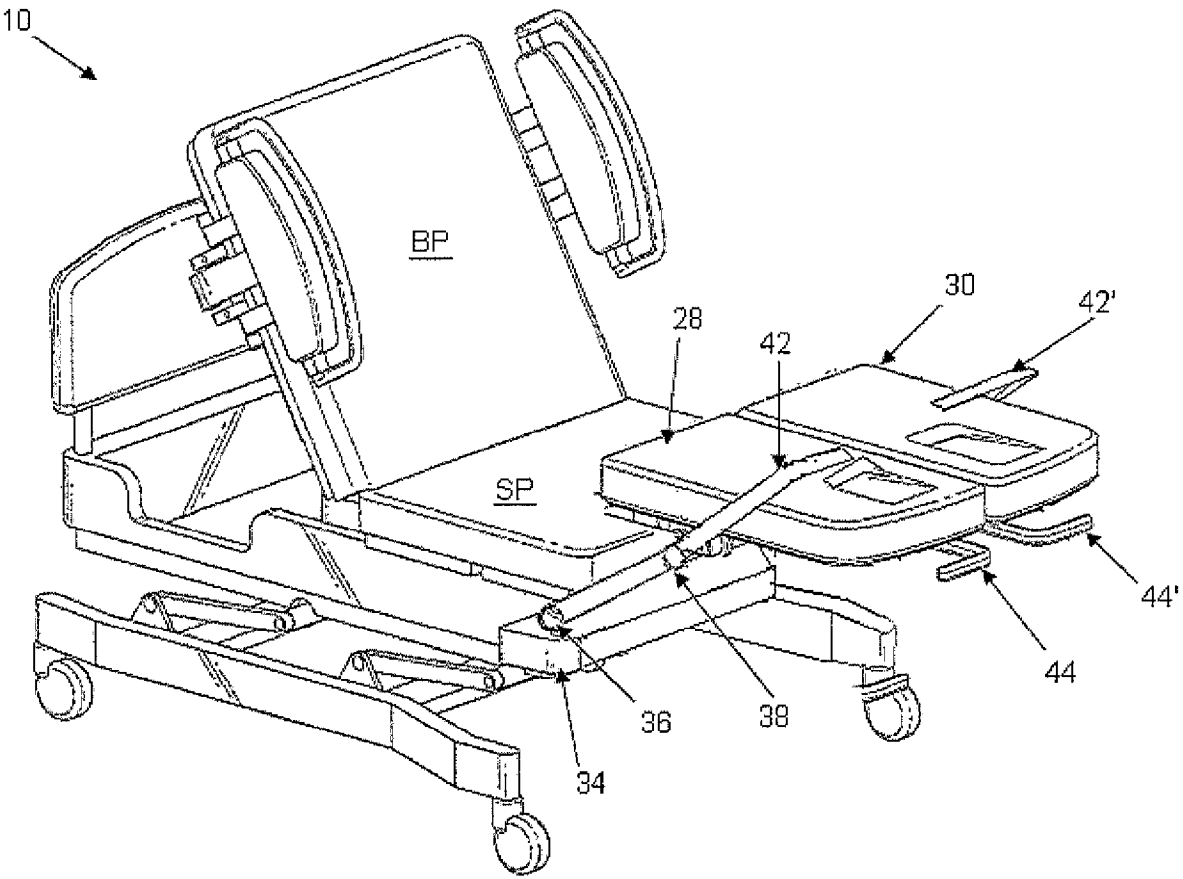
FIG. 7 is a perspective view of a person-support apparatus of FIG. 1 with the first and the second portions arranged in a calf support position.

In still another illustrative embodiment, the person-support apparatus 10 can be configured into a calf support position as shown in FIG. 7. In this position, support can be provided to the calf muscle region of a person seated/laying on the person-support apparatus 10 so that the calf muscle region is maintained above the lower pelvic region of the person. To achieve this configuration, the first foot portion 28 and second foot portion 30 are moved upward upon actuating the actuator 56, 58 to unlock the joints 34, 36, 38 and utilizing the outer handle 42 and/or the inner handle 44 to rotate the first foot portion 28 and the second foot portion 30 about the second rotational axis R2. The first foot portion 28 and the second foot portion 30 can be substantially parallel the seat portion S1 in this position.

Figure 8:
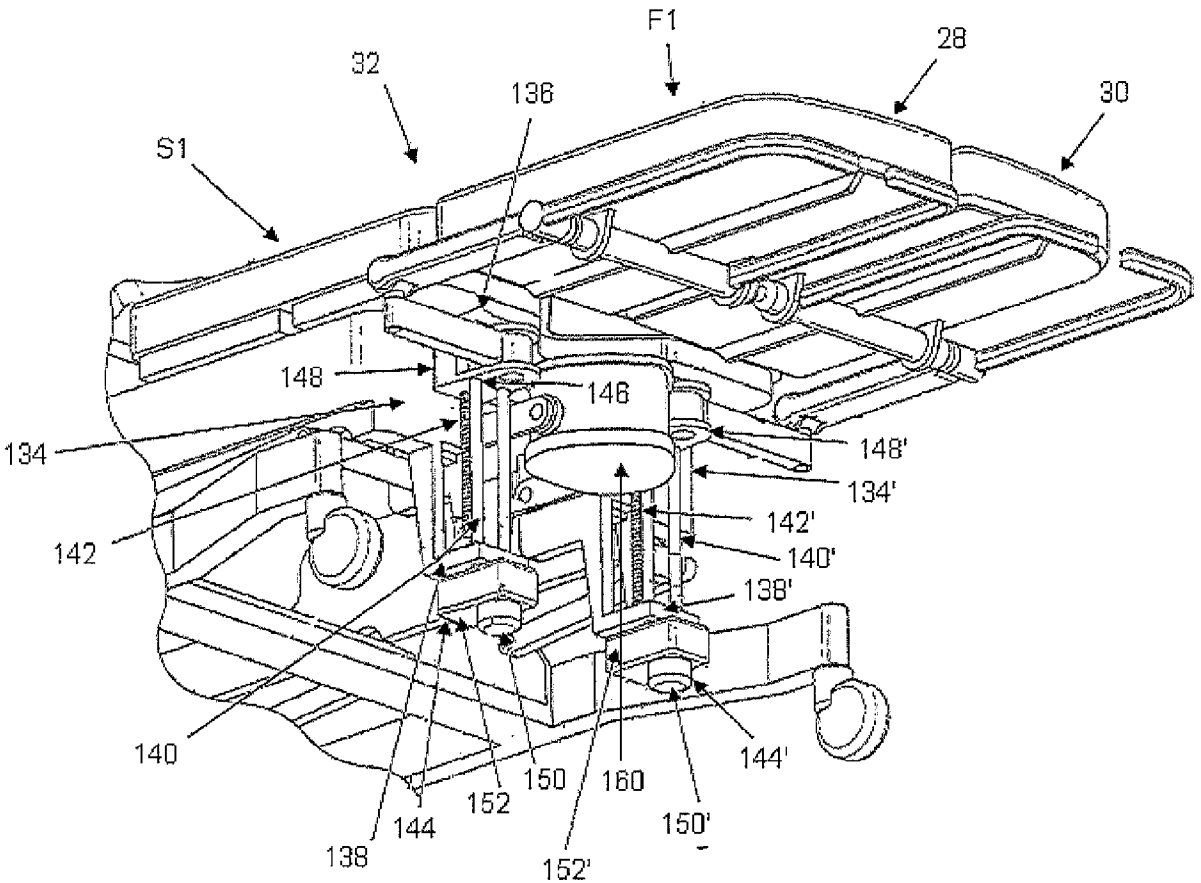
FIG. 8 is a perspective view of a person-support apparatus according to another illustrative embodiment of the disclosure.

In another embodiment of the disclosure, wherein like numerals represent similar features as in the other embodiments, the movement assembly 32 includes a height adjustment mechanism 134 that can cause the foot section F1 to translate horizontally and/or vertically with respect to the seat section S1 as shown in FIG. 8. It should be appreciated that the foot section F1 can translate vertically with respect to the seat section S1 while the upper frame 14 is raised or lowered with respect to the lower frame 12. The height adjusting mechanism 134 includes an upper bracket 136, a lower bracket 138, guide shafts 140, a threaded shaft 142, and an actuator 144. It should be appreciated that the height adjusting mechanism 134 can include a single guide shaft 140. The upper bracket 136 and the lower bracket 138 can be coupled with the upper frame 14 and can be vertically spaced apart. The upper bracket 136 and the lower bracket 138 can define the amount of vertical translation of the foot section F1. The upper bracket 136 and the lower bracket 138 can include at least one bore (not shown) therein that can receive at least one of the threaded shaft 142 and the guide shafts 140. It should be appreciated that the at least one bore (not shown) can include a portion of the actuator 144.

The guide shafts 140 can be coupled with the upper bracket 136 and the lower bracket 138 as shown in FIG. 8. The guide shafts 140 can be adapted to prevent rotation of the first joint receptacle 148 with respect to the seat section S1 as the threaded shaft 142 rotates to move the foot section F1 vertically between a first position and a second position. The guide shafts 140 can have a substantially smooth surface and can slidably engage a plurality of bores 146 in the first joint receptacle 148. It should be appreciated that the guide shafts 140 can include a protrusion thereon that prevents rotation of the first joint receptacle 148 as it moves vertically between a first position and a second position.

The threaded shaft 142 can be rotatably coupled with the upper bracket 136 and can extend through a bore (not shown) in the lower bracket 138 to rotatably engage the actuator 144 as shown in FIG. 8. It should be appreciated that the threaded shaft 142 can be replaced by a portion of the actuator 144. It should also be appreciated that the threaded shaft 142 can rotatably couple with the lower bracket 138 and a portion of the threaded shaft 142 engage the actuator 144. The threaded shaft 142 can rotatably engage a threaded bore 150 in the first joint receptacle 148 to move the first joint receptacle 148 vertically between a first position and a second position with respect to the seat section S1.

The actuator 144 can be coupled to the bottom of the lower bracket 138 as shown in FIG. 8. It should be appreciated that the actuator 144 can be coupled with the upper frame 14 or the upper bracket 136 or the first joint receptacle 148. The actuator 144 can include a remotely controlled motor 160 and a gearbox 152. It should be appreciated that the actuator 144 can be a linear actuator, a pneumatic actuator, a hydraulic actuator, or other similar actuators. It should also be appreciated that the actuator 144 can be remotely controlled by a controller (not shown). The motor 160 can include a motor shaft (not shown) that can rotatably engage a plurality of gears (not shown) in the gearbox 152. It should be appreciated that the motor shaft (not shown) can engage the threaded shaft 142 directly or be the threaded shaft 142. The gearbox 152 can receive the threaded shaft 142 therein and rotatably couple the threaded shaft 142 with the motor 160 through the plurality of gears (not shown). It should be appreciated that the threaded shaft 142 can have a gear (not shown) coupled to the end of the threaded shaft 142 and positioned within the gearbox 152. It should also be appreciated that a shaft (not shown) may extend from the gearbox 152 through the bore (not shown) in the lower bracket 138 and engage the threaded shaft 142.

In operation, the motor 160 can be energized, thereby causing the motor shaft (not shown) to rotate. The rotation of the motor shaft (not shown) can cause the gears (not shown) within the gearbox 152 to rotate. The rotation of the gears (not shown) can cause the threaded shaft 142 to rotate. The rotation of the threaded shaft 142 in cooperation with the guide shafts 140 can cause the first joint receptacle 148 to translate vertically with respect to the seat section S1. Once a desired height is achieved, the motor 160 can be de-energized to maintain the position of the foot section F1 with respect to the seat section S1.

Many other embodiments of the present disclosure are also envisioned. For example, a person-support apparatus comprises a frame including a torso support section and a foot support section. The foot support section includes a first portion and a second portion movable with respect to one another. The first portion and the second portion are adjacent one another and have respective first and second surfaces adapted to support at least a portion of the lower extremities of a person supported on the person-support apparatus when in a supine position. At least one of the first and second surfaces is movable to at least partially conform to the contour of an area of the lower extremity to assist in retaining the lower extremity.

In another example, a person-support apparatus comprises a frame including a torso support section and a foot support section. The foot support section includes a first portion and a second portion. At least one of the first portion and the second portion is movable with respect to the other from a first position to a second position wherein the first portion and the second portion are not adjacent to each other in the second position. In the second position, one of the first portion and the second portion is in a lower position relative the other of the first portion and the second portion. The portion of the foot support section in the lower position is adapted to support the bottoms of the feet of a person whose lower pelvic region is supported on the portion of the foot support section that is not in the lower position.

In yet another example, a person-support apparatus comprises a frame including a torso support section and a foot support section. The foot support section includes a first portion and a second portion having respective first and second surfaces adapted to support at least a portion of the lower extremities of a person supported on the person-support apparatus. The first portion and the second portion are movable between a first position proximate each other where the first and second surfaces support at least a portion of the lower extremities of a person in the supine position to a second position where at least a portion of the lower extremities of a person are supported on the first and second surfaces above the lower pelvic region of a person.

In still another example, a person-support apparatus comprises a lower frame, a support, and an upper frame. The support is coupled to the lower frame. The upper frame is supported on the support above the lower frame. The upper frame includes a torso support section and a foot support section including a first portion and a second portion. The first portion and the second portion are configured to support at least a portion of the lower extremities of a person supported on the person-support apparatus. No components of the foot support section are removed when the first portion and the second portion are moved from a first position to a second position.

In yet another example, a person-support apparatus comprises a frame including a torso support section and a foot support section. The foot support section includes a first portion and a second portion. The first portion and the second portion are movable between a first position proximate one another for supporting a person's lower extremities when in supine position to a second position where the first portion and the second portion are at an angle with respect to orientation of the first portion and the second portion in the first position. A gap is defined between the torso support section and the first and second portions such that the portions are configured to support the upper torso of a person seated on the torso support section and leaning on the at least one of the first and second portions.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A person-support apparatus, comprising:

a frame including a torso support section and a foot support section, the foot support section including a first portion and a second portion having respective first and second surfaces adapted to support at least a portion of the lower extremities of a person supported on the person-support apparatus, wherein the first portion and the second portion are movable between a first position, where the first portion and the second portion are proximate each other and the first and second surfaces support at least a portion of the lower extremities of a person in the supine position, to a second position where at least a portion of the lower extremities of a person are supported on the first and second surfaces above the lower pelvic region of a person, and wherein the first portion and the second portion include first and second handles that extend along a portion of the perimeter of the first portion and the second portion, respectively, the first handle and the second handle being configured to gripped by a user to move the first portion and the second portion between the first position and the second position, wherein the first and second portions of the lower support section each include a longitudinal length and a lateral width shorter than the longitudinal length and first and second ends spaced apart by the longitudinal length, the first and second portions supported in a cantilevered fashion for movement relative to the torso support section about a lateral axis and pivotable about a fulcrum positioned between the first and second ends and generally perpendicular to the longitudinal length, the fulcrum spaced apart from the lateral axis such that at least one of the first and second portions are independently movable to a third position in which the first end is positioned vertically lower than the fulcrum and the second end is positioned vertically higher than the fulcrum.

2. The person-support apparatus of claim 1, wherein the first portion and the second portion are configured to be raised and separated when moved from the first position to the second position.

3. The person-support apparatus of claim 1, further comprising a locking mechanism configured to selectively maintain the orientation of at least one of the first portion and the second portion with respect to the torso support section.

4. The person-support apparatus of claim 1, further comprising a locking mechanism configured to selectively maintain the orientation of at least one of the first portion and the second portion with respect to the torso support section, at least one of the first handle and the second handle including an actuation device configured to actuate the locking mechanism to selectively allow at least one of the first portion and the second portion to move with respect to the torso support section.

5. A person-support apparatus, comprising:

a lower frame;

a support coupled to the lower frame;

an upper frame supported on the support above the lower frame, the upper frame including a torso support section and a lower extremity support section, the lower extremity support section including a first portion and a second portion, the first portion and the second portion being configured to support at least a portion of the lower extremities of a person supported on the person-support apparatus, wherein no components of the lower extremity support section are removed when the first portion and the second portion are moved from a first position to a second position, wherein the first and second portions of the lower support section each define a plane and include (i) a longitudinal length, (ii) a lateral width shorter than the longitudinal length, and (iii) first and second ends spaced apart by the longitudinal length positioned in the plane, the first end positioned nearer the torso support section than the second end, the first and second portions supported in a cantilevered fashion for movement relative to the torso support section about a lateral axis and pivotable about a fulcrum positioned between the first and second ends and generally perpendicular to the longitudinal length, the fulcrum spaced apart from the lateral axis such that the first and second portions are independently movable and configured to rotate about the fulcrum to a position in which the first and second ends remain positioned in the plane and the first end is positioned vertically lower than the fulcrum and the second end is positioned vertically higher than the fulcrum.

6. The person-support apparatus of claim 5, wherein the first and the second portion are capable of vertical translational movement by a remotely controlled motor.

7. The person-support apparatus of claim 5, further comprising a first movable joint, a second movable joint, and a third movable joint, the first movable joint and the second movable joint facilitating movement of the first portion and the second portion about substantially horizontal axes, the third movable joint facilitating movement of the first portion and the second portion about substantially vertical axes.

8. The person-support apparatus of claim 7, wherein at least one of the first movable joint, the second movable joint, and the third movable joint are at least one of remotely operable and selectively lockable.

9. The person-support apparatus of claim 5, wherein the first portion and the second portion are capable of horizontal movement about substantially horizontal axes and vertical movement about substantially vertical axes, the horizontal movement and the vertical movement being independent of each other to facilitate positioning of the first portion and the second portion in a plurality of positions.

10. The person-support apparatus of claim 9, wherein the first and the second portion are capable of fourth translational movement along substantially vertical axis by a remotely controlled motor.

11. A person-support apparatus, comprising:

a frame including a torso support section, a seat support section, and a lower extremity support section movably coupled to the seat support section, the lower extremity support section including a first portion and a second portion, wherein the first portion and the second portion are movable between a first position for supporting a person's lower extremities to a second position for supporting the torso of a person supported on the frame in a forward leaning posture, wherein the first and second portions of the lower support section each define a plane and include (i) a longitudinal length, (ii) a lateral width shorter than the longitudinal length, and (iii) first and second ends spaced apart by the longitudinal length positioned in the plane, the first end positioned nearer the seat support section than the second end, the first and second portions supported in a cantilevered fashion for movement relative to the torso support section about a lateral axis and pivotable about a fulcrum positioned between the first and second ends and generally perpendicular to the longitudinal length, the fulcrum spaced apart from the lateral axis such that the first and second portions are independently movable and configured to rotate about the fulcrum to a position in which the first and second ends remain positioned in the plane and the first end is positioned vertically lower than the fulcrum and the second end is positioned vertically higher than the fulcrum.

12. The person-support apparatus of claim 11, wherein the first portion and the second portion include first and second handles, respectively, with actuators thereon, the actuators being operable to unlock the plurality of movable joints and the first and second handles being configured to move the first portion and second portion between the first position to the second position while the plurality of movable joints are unlocked.

13. The person-support apparatus of claim 11, wherein the movement of the lower extremity support section from the first position to the second position creates a gap between the lower extremity support section and the seat section such that a person supported on the frame can position at least a portion of their lower extremities between the lower extremity support section and the seat section.

14. The person-support apparatus of claim 11, wherein, in the second position, at least one of the first portion and the second portion are substantially vertically oriented.

15. A person-support apparatus comprising a lower frame, an upper frame movable vertically relative to the lower frame, a torso support section supported on the upper frame, a seat support section supported on the upper frame, and a lower extremity support section supported on the upper frame, the lower extremity support section including a first member and a second member, the first member movable relative to the upper frame about a first generally vertical axis and a first generally horizontal axis and the second member movable relative to the upper frame about a second generally vertical axis and a second generally horizontal axis, the first member supported on a first fulcrum of a first movement member connecting the first member of the lower extremity support section to the upper frame, the first fulcrum pivotable about the first generally horizontal axis and spaced apart from the first generally horizontal axis such that the first member is pivotable about the first fulcrum to change the attitude of the first member relative to the upper frame and the first movement member, and the second member supported on a second fulcrum of a second movement member connecting the second member of the lower extremity support section to the upper frame, the second fulcrum pivotable about the second generally horizontal axis and spaced apart from the second generally horizontal axis such that the second member is pivotable about the second fulcrum to change the attitude of the second member relative to the upper frame and the second movement member, wherein the first member and the second member of the lower extremity support section are positionable to cooperate to define a generally planar lower extremity support surface that is generally co-planar with a support surface formed by the torso support section and the seat support section and the first and second members are each movable to a position in which the generally planar lower extremity support surface is generally perpendicular to the support surface formed by the torso support section and the seat support section.

16. The person-support apparatus of claim 15, further comprising a locking mechanism configured to selectively maintain the orientation of at least one of the first portion and the second portion with respect to the torso support section.

17. The person-support apparatus of claim 15, wherein the first member and the second member each have respective first and second surfaces adapted to support at least a portion of the lower extremities of a person supported on the person-support apparatus, a portion of at least one of the first and second surfaces being deformable to at least partially conform to the contour of an area of the lower extremity to assist in retaining the lower extremity.

18. The person-support apparatus of claim 17, wherein the portion of at least one of the first and second surfaces being deformable to at least partially conform to the contour of an area of the lower extremity to assist in retaining the lower extremity may be deformed by an actuator.

19. The person-support apparatus of claim 17, wherein the portion of at least one of the first and second surfaces being deformable to at least partially conform to the contour of an area of the lower extremity to assist in retaining the lower extremity may be deformed manually.

20. The person-support apparatus of claim 15, wherein the first and the second members are capable of vertical translational movement relative to the upper frame.

21. The person-support apparatus of claim 20, wherein the vertical translational movement is motorized.

22. A person-support apparatus comprising a lower frame, an upper frame movable vertically relative to the lower frame, a torso support section supported on the upper frame, a seat support section supported on the upper frame, and a lower extremity support section supported on the upper frame, the lower extremity support section including a first member and a second member, the first member movable relative to the upper frame about a first generally vertical axis and a first generally horizontal axis and the second member movable relative to the upper frame about a second generally vertical axis and a second generally horizontal axis, the first member supported on a first fulcrum pivotable about the first generally horizontal axis and spaced apart from the first generally horizontal axis such that the first member is pivotable about the first fulcrum to change the attitude of the first member relative to the upper frame, and the second member supported on a second fulcrum pivotable about the second generally horizontal axis and spaced apart from the second generally horizontal axis such that the second member is pivotable about the second fulcrum to change the attitude of the second member relative to the upper frame, wherein the first member and the second member of the lower extremity support section are positionable to cooperate to define a generally planar lower extremity support surface that is generally co-planar with a support surface formed by the torso support section and the seat support section and the first and second members are each movable to a position in which the generally planar lower extremity support surface is generally perpendicular to the support surface formed by the torso support section and the seat support section, wherein the first and the second members are capable of vertical translational movement relative to the upper frame, wherein the vertical translational movement is motorized, wherein the first member and the second member include first and second handles, respectively, with actuators thereon, the actuators being movable between a first position in which the respective first or second member is not movable relative to the fulcrum and a second position wherein the respective first or second member is free to move relative to the fulcrum.

23. The person-support apparatus of claim 22, wherein the first position of the actuators retains the first or second member relative to the respective first and second horizontal axes and respective first and second vertical axes.

* * * * *